US012693029B2

(12) United States Patent
Fulda

(10) Patent No.: US 12,693,029 B2
(45) Date of Patent: Jul. 28, 2026

(54) OUTDOOR COIL AND FAN CONFIGURATION FOR A PACKAGED TERMINAL AIR CONDITIONER (PTAC)

(71) Applicant: Yehuda Fulda, Beit Shemesh (IL)

(72) Inventor: Yehuda Fulda, Beit Shemesh (IL)

( * ) Notice: Subject to any disclaimer, the term of this patent is extended or adjusted under 35 U.S.C. 154(b) by 88 days.

(21) Appl. No.: 18/737,973

(22) Filed: Jun. 8, 2024

(65) Prior Publication Data

US 2024/0328638 A1 Oct. 3, 2024

Related U.S. Application Data

(60) Provisional application No. 63/541,864, filed on Oct. 1, 2023.

(51) Int. Cl.
*F24F 1/0057* (2019.01)
*F24F 1/0067* (2019.01)
*F24F 13/20* (2006.01)

(52) U.S. Cl.
CPC ..... *F24F 1/0057* (2019.02); *F24F 1/0067* (2019.02); *F24F 2013/205* (2013.01)

(58) Field of Classification Search
CPC ..... F24F 1/0057; F24F 1/0067; F24F 1/027; F24F 1/0287; F24F 1/028; F24F 1/031; F24F 1/38; F24F 2013/205; F24F 2221/20
See application file for complete search history.

(56) References Cited

U.S. PATENT DOCUMENTS 4,370,863 A * 2/1983 Fisher ..... F25B 39/04 62/506
2008/0159872 A1* 7/2008 Park ..... F24F 13/24 416/244 R

FOREIGN PATENT DOCUMENTS

CN 111271777 A * 6/2020 ..... F24F 11/89

OTHER PUBLICATIONS

Machine translation CN 111271777 (Year: 2020).*

* cited by examiner

*Primary Examiner* — Joseph F Trpisovsky

(57) ABSTRACT

Provided is a packaged terminal air conditioner (PTAC) system that includes a sleeve enclosing an outdoor portion. The outdoor portion includes an outdoor coil having one or two wings, and an outdoor fan configured horizontally along the Vertical direction (V) facing towards the top wall of the sleeve above the outdoor coil or facing towards a bottom plate below the outdoor coil. During the operation of the PTAC system, the hot air is pulled from the inside of the outdoor portion and upward or downward and is discharged out from the top or bottom by the outdoor fan.

12 Claims, 13 Drawing Sheets

OUTDOOR COIL AND FAN CONFIGURATION FOR A PACKAGED TERMINAL AIR CONDITIONER (PTAC)

CROSS-REFERENCE TO RELATED PATENT DOCUMENTS

This patent application claims the benefit of priority of U.S. Provisional Patent Application No. 63/541,864, entitled "NOVEL OUTDOOR COIL AND FAN CONFIGURATION FOR A PACKAGED TERMINAL AIR CONDITIONER (PTAC)," filed Oct. 1, 2023, which is incorporated herein by reference in its entirety.

TECHNICAL FIELD

This invention relates generally to the field of air conditioner systems, and more particularly to a power-efficient PTAC system with a novel outdoor coil and fan configuration that allows efficient airflow.

BACKGROUND

Typical packaged terminal air conditioning (PTAC) systems such as the one shown in FIGS. 1A, and 1B are well-known and widely used in commercial buildings (such as hotels) and residential sites to adjust the temperature indoors. PTAC system 100 is a self-contained air conditioning and heat unit designed to heat and cool a limited space. Although PTACs are self-contained, they include both an indoor portion 102 and an outdoor portion 104 separated usually by an intermediate separation wall 105. PTACs often need to draw air from the outdoor portion 104 into the indoor portion 102. PTAC systems are installed on the exterior wall 200 (as seen in FIG. 7 and FIG. 8) or windows of the building such that the air inlet portion of the system 100 generally projects outward beyond the outer wall of the building and the air venting portions 109*a*, 109*b* of the system are positioned inward through the interior wall 202. Generally, the heating and cooling mechanism is housed within a sleeve/housing 106. Particularly, the outdoor portion 104 includes elements that are housed within the sleeve 106 and present behind the separation wall 105. The indoor portion 102 includes elements that are present within the interior 202 of the room and projects inwards within the room and is covered by a cover panel. PTAC also includes a closed refrigeration loop to heat or cool the indoor air of the living space. Typically, the indoor air is recirculated while being heated or cooled using a typical PTAC system. The compressor/heat pump plays an important role and does most of the work (resulting in more power consumption) of taking in outdoor air and then performing necessary cooling and heating on this drawn air in order to pass on the resultant conditioned air in the room via the air venting portion 109*a*, 109*b* of the system 100.

In a typical PTAC, as seen in FIG. 1B, the outdoor fan is located at the back of the outdoor coil and is vertically aligned. The outside air flows from the sides of the outdoor fan and the outdoor fan blows the air through the outdoor coil. In other words, the air discharge or air exhaust happens in the middle of the PTAC whereas air intake is from the two sides. Alternatively, in some existing PTACs, the PTACs are designed for air intake to happen from one side and air exhaust to happen from one side. Such a typical PTAC system 100 consumes more power and is less efficient as the hot air movement in such a typical PTAC is from side to side as indicated by arrows in FIG. 1B.

The inventor herein proposes a novel configuration for the outdoor coil and fan for a PTAC wherein the hot air movement would be from bottom to top or from top to bottom and would increase the overall efficiency of a PTAC system.

SUMMARY

The present invention has been designed to address the issues discussed above and others with an object to provide a novel configuration for a PTAC system.

Another objective of the present invention is to provide an outdoor fan horizontally oriented along the vertical direction (V) above the C-shaped outdoor coil or L-shaped outdoor coil.

Another objective of the present invention is to provide an outdoor fan horizontally oriented along the vertical direction (V) below the C-shaped outdoor coil or L-shaped outdoor coil.

According to embodiments of the present invention, there is provided a packaged terminal air conditioner (PTAC) system. The PTAC system comprises a sleeve embodying an indoor portion, and an outdoor portion. In the proposed PTAC system, the outdoor portion includes an outdoor coil comprising at least one wing, and the outdoor fan is configured horizontally along the Vertical direction (V) facing toward the top wall of the sleeve above the outdoor coil. During the operation of the proposed PTAC system, the hot air is pulled from the inside and upward and is discharged out from the top by the outdoor fan according to an embodiment. In another embodiment, the outdoor fan may be configured horizontally along the Vertical direction (V) facing toward a bottom plate of the PTAC unit and oriented below the outdoor coil. During the operation of the proposed PTAC system, the hot air is pulled from the inside of the outdoor unit and downward and is discharged out from the bottom of the PTAC system by the outdoor fan.

According to one embodiment, the outdoor coil comprises a single wing leading to an L-shaped configuration for the outdoor coil.

According to one embodiment, the outdoor coil comprises a pair of wings leading to a C-shaped configuration for the outdoor coil.

Various advantages and features of the present invention are described herein with specificity to make the present invention understandable to one of ordinary skill in the art, both with respect to how to practice the present invention and how to make the present invention.

BRIEF DESCRIPTION OF THE DRAWINGS

The above set forth and other features of the present invention are made more apparent in the ensuing description of the preferred embodiments when read in conjunction with the attached drawings, wherein.

DETAILED DESCRIPTION

Certain terminology is used in the following description for reference only and is not limiting. Unless specifically set forth herein, the terms "a," "an," and "the" are not limited to one element, but instead should be read as meaning "at least one." The terminology includes the words noted above, derivatives thereof, and words of similar import. Before describing the present invention in detail, it should be observed that the present invention utilizes a combination of components, which constitutes a novel configuration for a PTAC system. Accordingly, the components have been represented, showing only specific details that are pertinent for an understanding of the present invention so as not to obscure the disclosure with details that may be readily apparent to those with ordinary skill in the art having the benefit of the description herein. As required, the detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The words "comprising", "having", "containing", and "including", and other forms thereof, are intended to be equivalent in meaning and be open-ended in that an item or items following any one of these words is not meant to be an exhaustive listing of such item or items or meant to be limited to only the listed item or items.

Figure 1A:
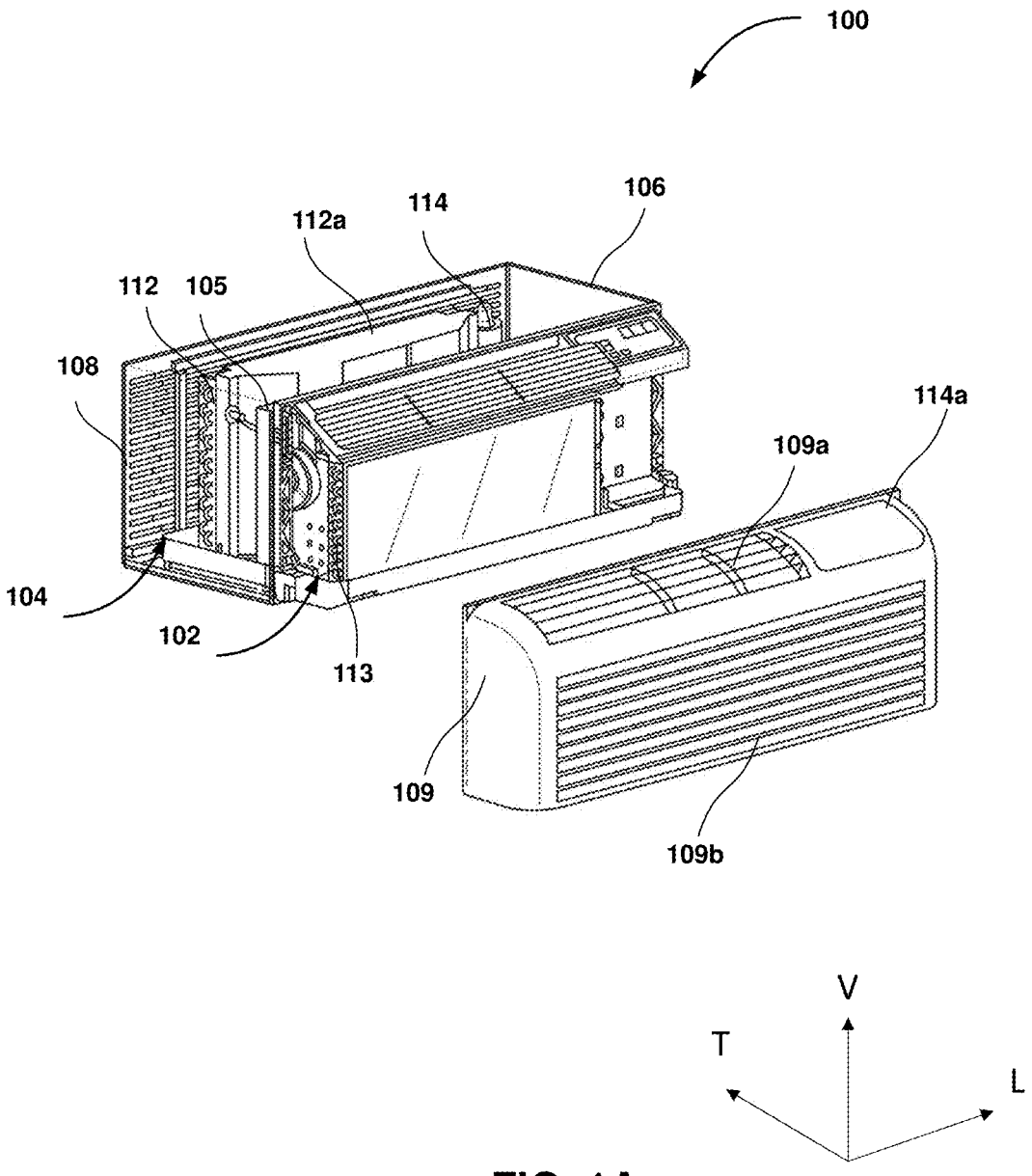
FIG. 1A (Prior Art)
FIGS. 1A and 1B show an exploded view of a typical prior art PTAC system.
Figure 1B:
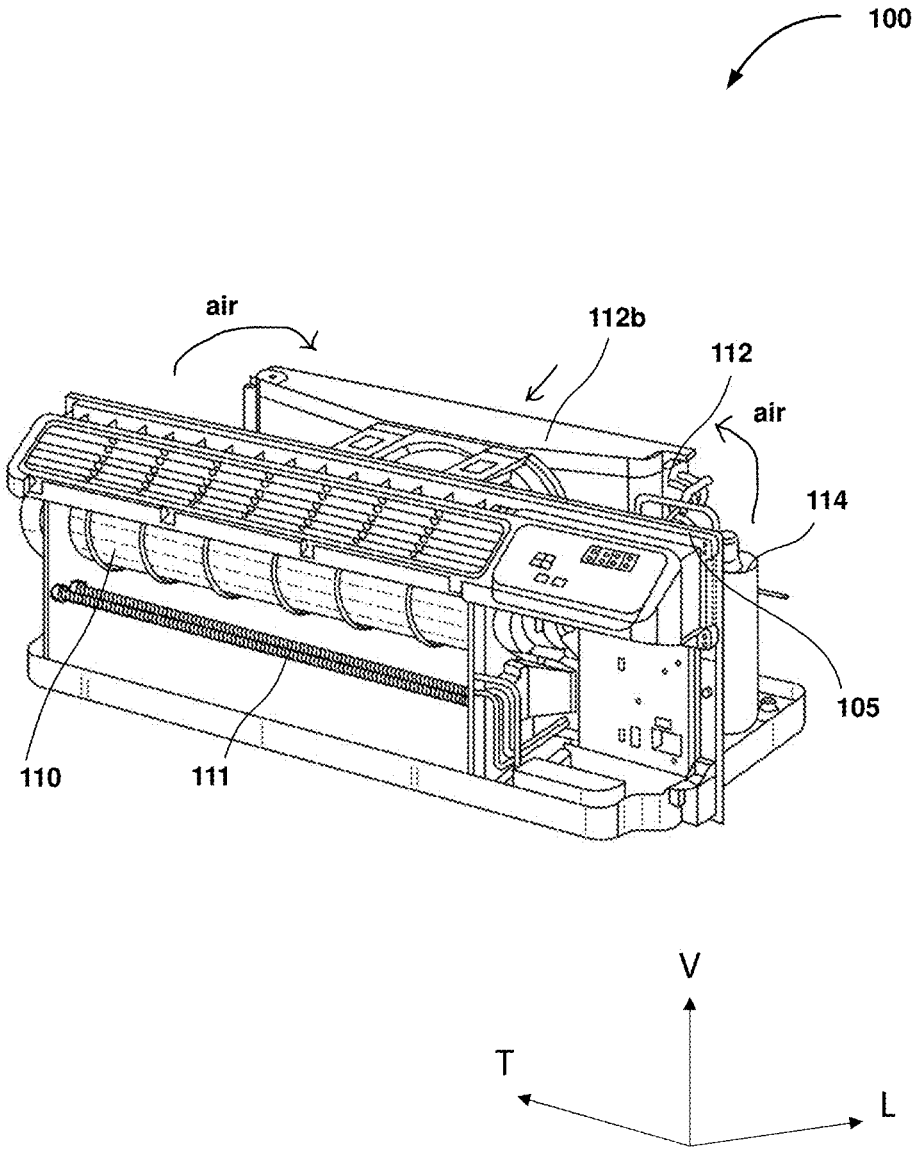
FIG. 1B (Prior Art)

Referring now to FIGS. 1A and 1B, a typical traditional packaged terminal air conditioning (PTAC) unit 100 is shown. The PTAC unit 100 includes an indoor portion 102 and an outdoor portion 104 separated by an intermediate wall 105. The indoor portion 102 and the outdoor portion 104 generally define a vertical direction V, a lateral direction L, and a transverse direction T, all oriented perpendicular to each other.

A housing/sleeve 106 of the PTAC 100 may contain various other components, for example, a rear grill 108 as part of the outdoor portion 104, and a front panel/cover 109 as part of the indoor portion 102. The rear grill 108 and the front panel cover 109 are disposed of in spaced-apart relation along the transverse direction T. The rear grill 108 consists of a plurality of uniform openings to allow airflow therethrough.

The components of the outdoor portion 104, such as an outdoor heat exchanger/outdoor coil 112, an outdoor fan (not seen), and a compressor 114 may be housed within the housing/sleeve 106. The outdoor fan is preferably a linear fan that pushes the air through the outdoor coil 112. The outdoor fan and the outdoor heat exchanger or coil 112 are mounted in a spaced-apart relation long direction T. The compressor 114 is housed towards the lateral direction L with respect to the outdoor fan. Particularly, the compressor 114 and associated fluid lines are housed behind a control panel 114*a* (along direction T). The control panel 114*a* consists of one or more input buttons and display means.

Typically, as seen in FIG. 1B, the outdoor fan is located at the back of the outdoor coil 112 and are vertically aligned. The outside air flows from the sides of the fan and the outdoor fan blows the air through the outdoor coil. In other words, the air discharge or air exhaust happens in the middle of the PTAC whereas air intake is from the two sides. Alternatively, in some existing PTACs, the PTACs are designed for air intake to happen from one side and air exhaust to happen from one side. As seen, the hot air movement inside the PTAC 100 is side to side.

The indoor portion 102 may include, for example, an indoor heat exchanger/indoor coil 113, an indoor fan (not shown), and a heating unit (not shown). These components may be housed behind the front panel cover 109 of the PTAC. The intermediate wall 105 generally defines the indoor portion 102 and outdoor portion 104 and functions to separate them. As shown, in the conventional PTAC unit 100, the outdoor heat exchanger 112 is configured parallel to the indoor heat exchanger 113, and the outdoor fan is located behind and in between the outdoor heat exchanger 112 and the intermediate wall 105. The outdoor fan may be encased inside a casing.

Figure 1C:
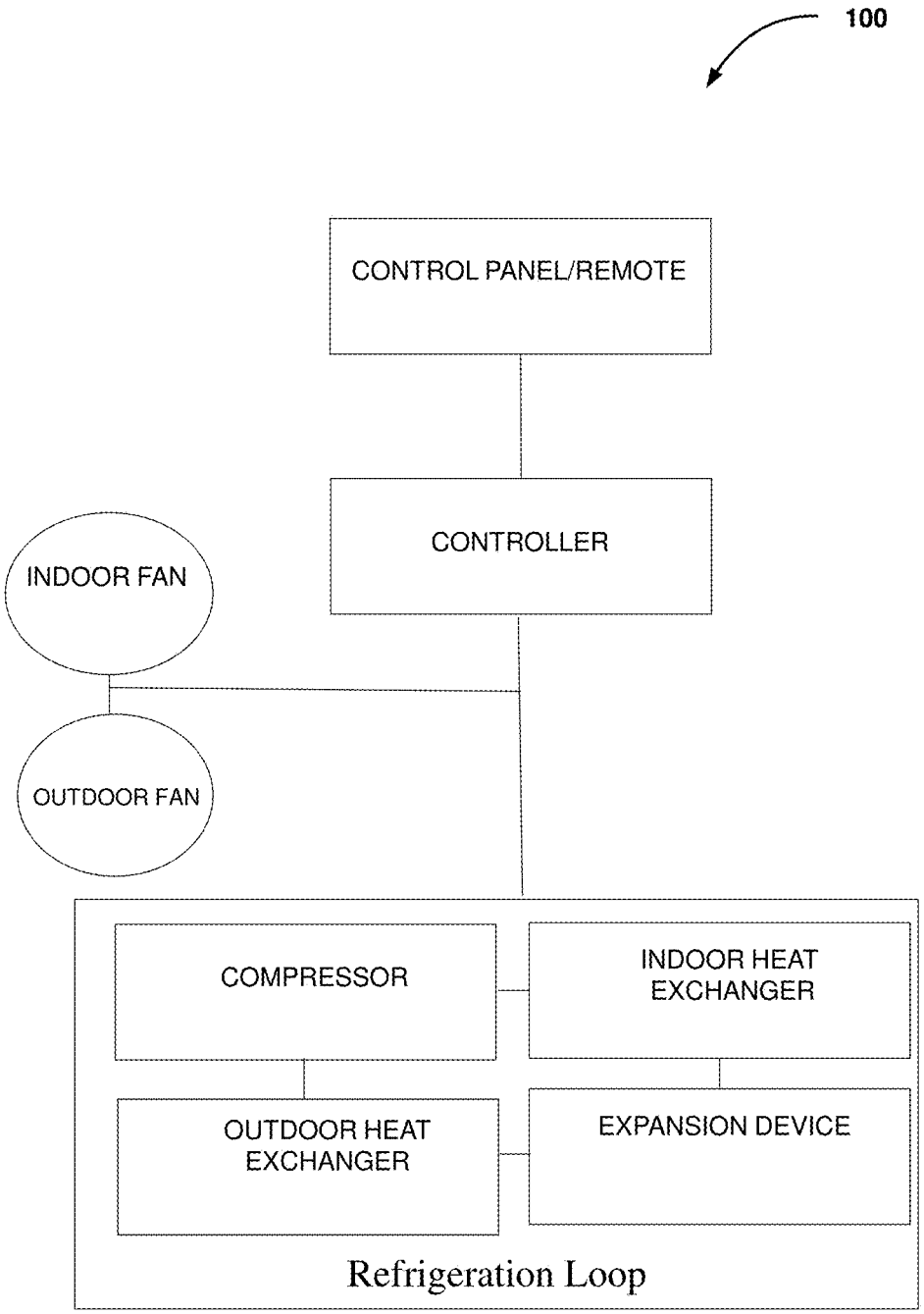
FIG. 1C (Prior Art)
FIG. 1C shows a block diagram of a typical prior art PTAC system.
Figure 2:
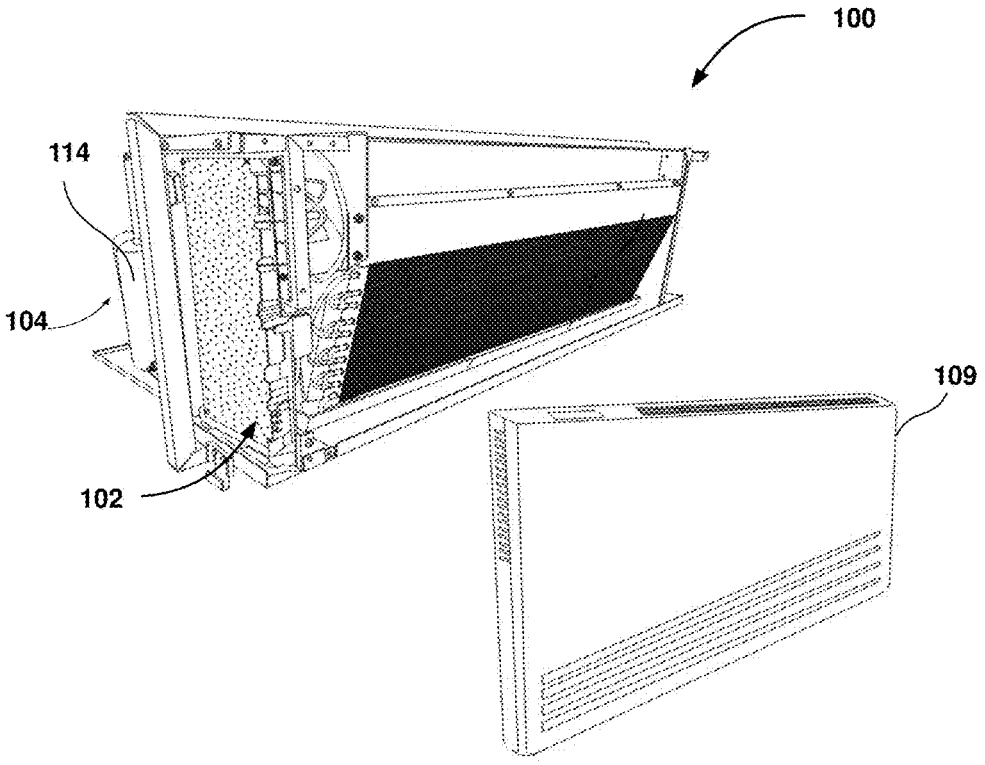
FIGS. 2 and 3 show an exploded view of the PTAC system, according to one embodiment of the present invention.

Referring to FIG. 1C, the PTAC system 100 also includes a refrigeration loop consisting of the outdoor and indoor heat exchangers, the compressor 114, and an expansion device (not shown). The compressor 114 and expansion device may be in fluid communication with outdoor heat exchanger 112 and indoor heat exchanger for the flow of refrigerant (Eg. R401a) therethrough as known in the art. More particularly, the refrigeration loop may include various flow lines to allow the flow of refrigerant between the various components of the refrigeration loop. Refrigerants can flow through such lines from the indoor heat exchanger to the compressor 114, from the compressor 114 to the outdoor heat exchanger 112, from the outdoor heat exchanger 112 to the expansion device, and from the expansion device to the indoor heat exchanger. The refrigerant may generally undergo phase changes associated with a refrigeration cycle as it flows to and through these various components, as is generally known in the art. The refrigeration loop may be operated in a cooling mode or a heating mode using the one or more buttons provided on the control panel or using a remote-control device (not shown) provided with the PTAC unit 100, depending upon which the indoor heat exchanger may act as an evaporator and the outdoor heat exchanger 112 acts as a condenser or vice versa. As known in the art, the outdoor and indoor heat exchangers include coils through which the refrigerant may flow for heat exchange purposes. The compressor 114 as used and preferred may be a variable speed compressor that may be operated at various speeds depending on the air conditioning need of the room and the demand of the refrigeration loop. The compressor 114 plays an important role in cooling or heating the outdoor air before sending it to the room and is operational all the time during the operation of the typical PTAC.

Compared to the traditional PTAC configuration, the inventor herein proposes a novel PTAC system with an efficient outdoor fan and coil configuration for the PTAC according to various embodiments that would make the PTAC more efficient.

Figure 5A:
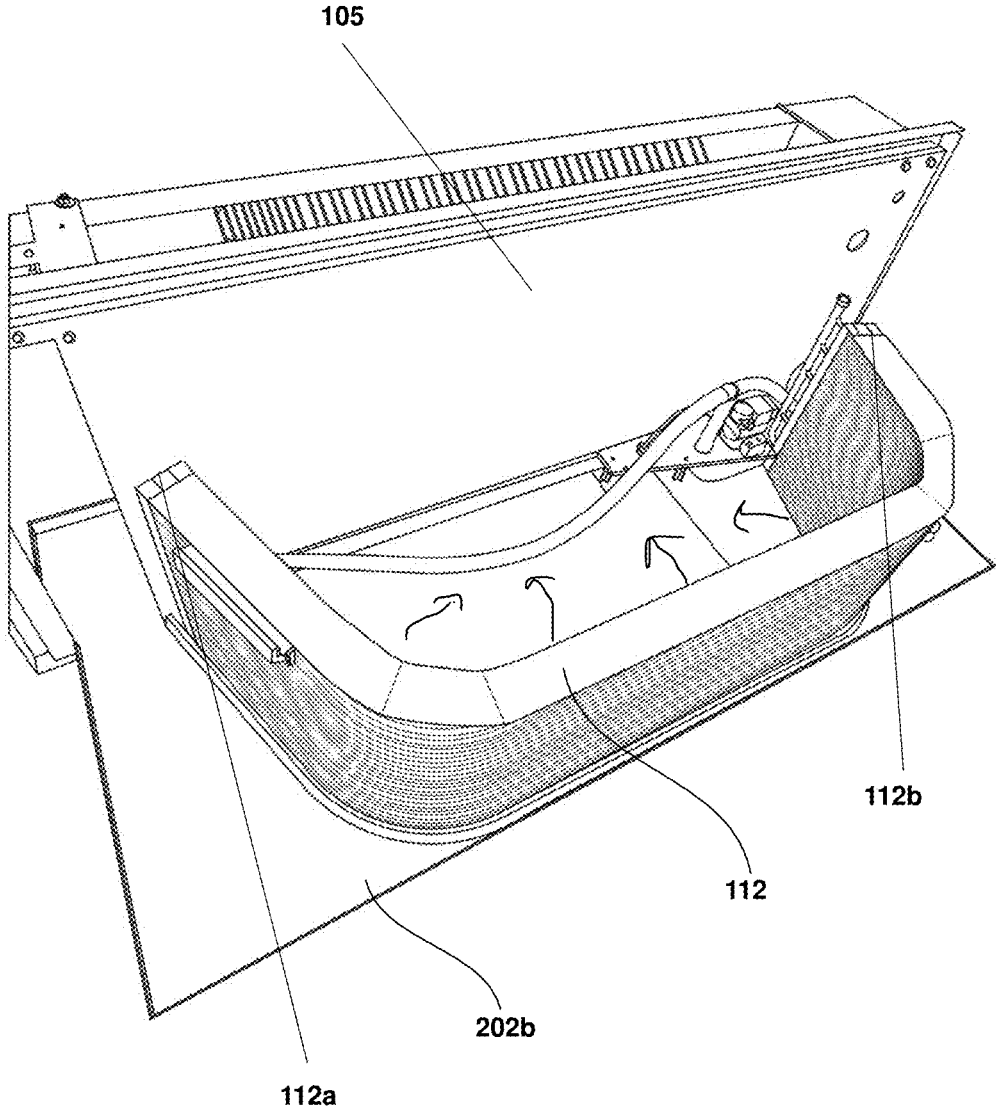
FIG. 5A shows a top back-perspective view of the PTAC system with the outdoor fan and sleeve removed.
Figure 5B:
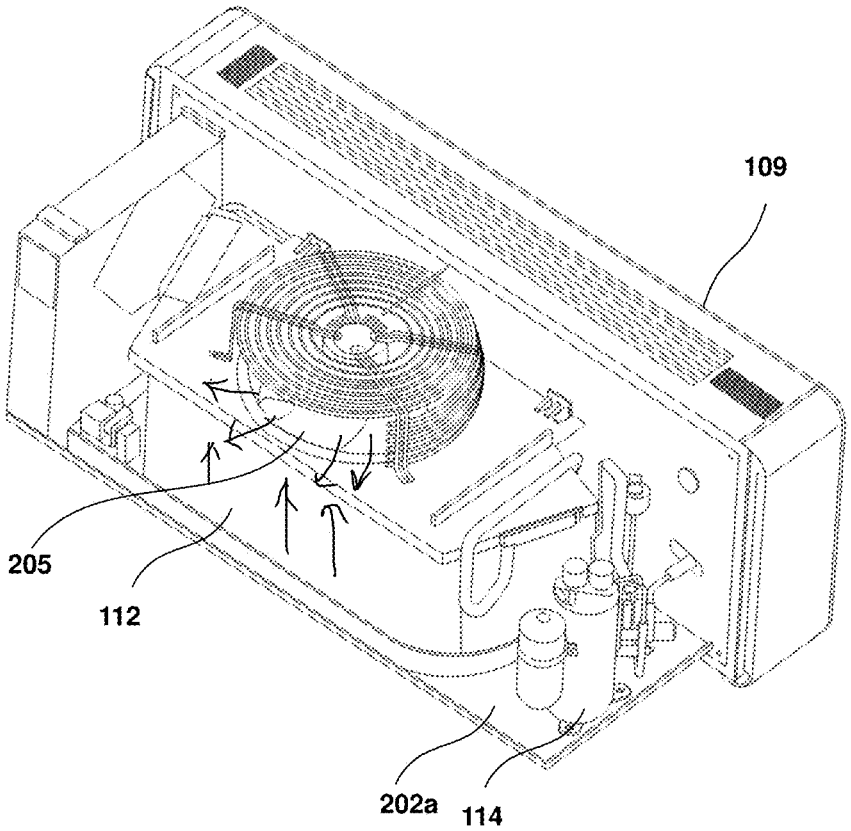
FIG. 5B shows a back-perspective view of the PTAC system with the sleeve removed.
Figure 6:
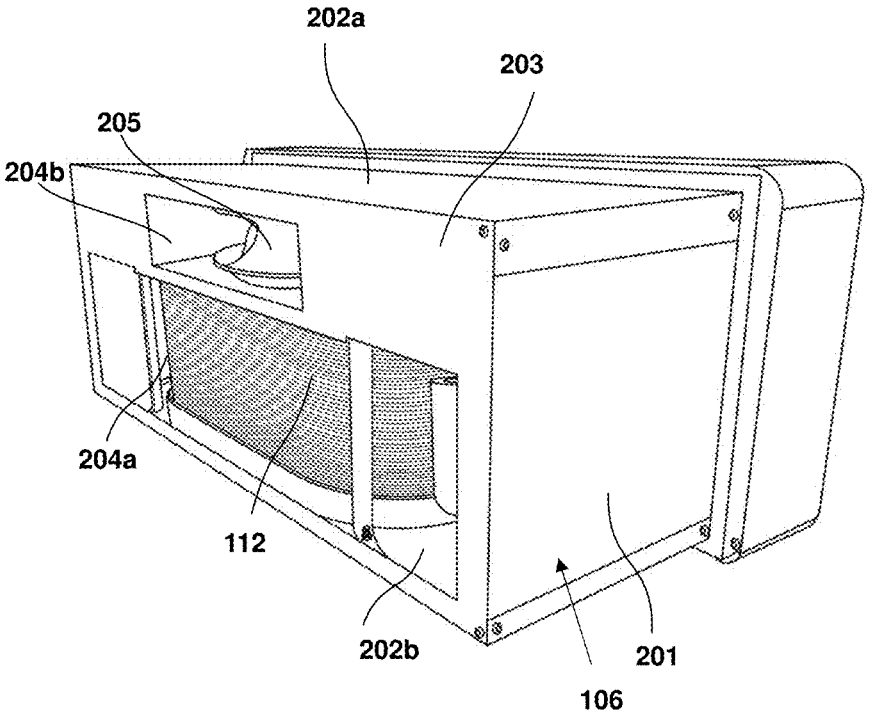
FIG. 6 shows a back perspective view of the PTAC system of FIGS. 2-3 in a completely assembled form.

The inventor herein has envisioned a strategic configuration of the outdoor coil 112 and the outdoor fan 205 (hereinafter the outdoor fan 112 is referred to as outdoor fan 205) within the housing/sleeve 106 of the PTAC 100 such as to increase the overall efficiency of the PTAC 100. The outdoor coil 112 is strategically shaped in a C shape or L shape, and the outdoor fan 205 is horizontally positioned on top of the outdoor coil as seen in FIGS. 5B and 6 according to one embodiment. In the proposed design the outdoor coil 112 is C-shaped (FIG. 5A) or L-shaped (not seen) and is horizontally aligned with the outdoor fan 205. The C-shaped coil 112 (FIG. 5A) maximizes the surface area, and the outdoor fan 205 is located on top of the outdoor coil 112. In this configuration of the outdoor fan 205 and coil 112, the air is pulled from the inside of the outdoor unit 104 (and passed through the coil) and upward and is discharged out from the top by the outdoor fan 205 as indicated by the arrows in FIGS. 5A and 5B. This movement of the hot air from the bottom to the top of the PTAC 100 increases the efficiency of the PTAC compared to the typical PTAC system.

Figure 9:
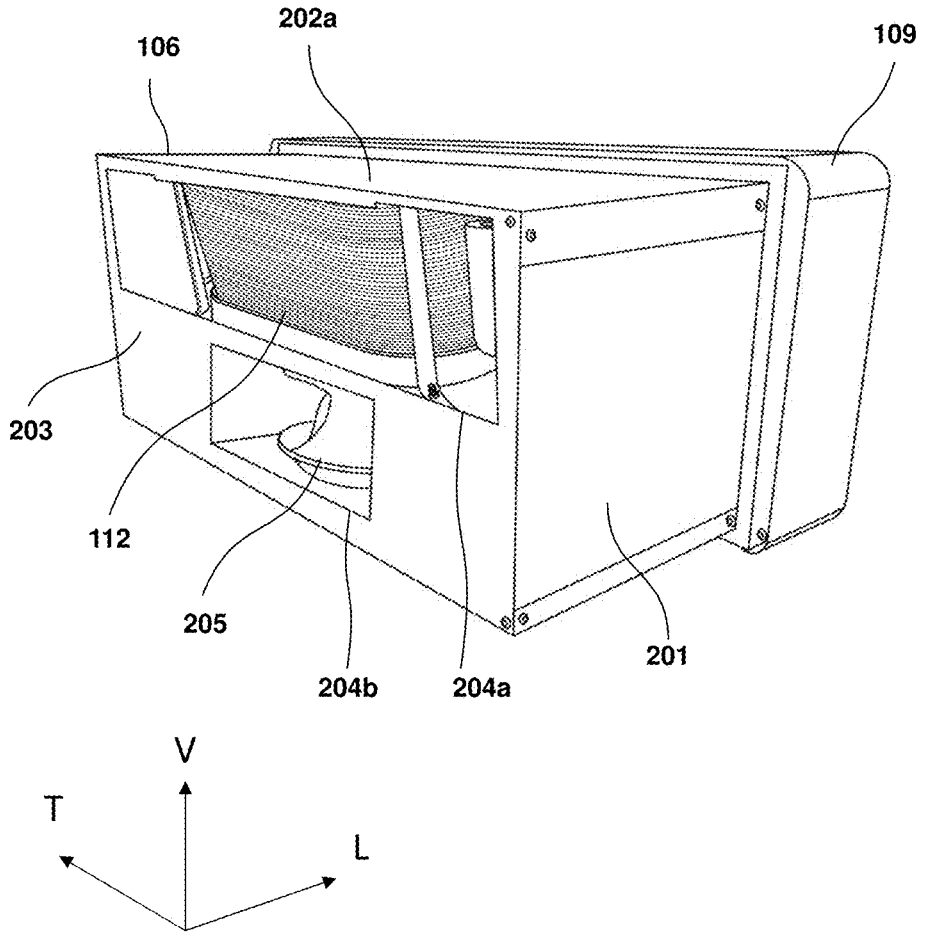
FIGS. 9-11 shows an exploded view of the PTAC system, according to another embodiment of the present invention.
Figure 10:
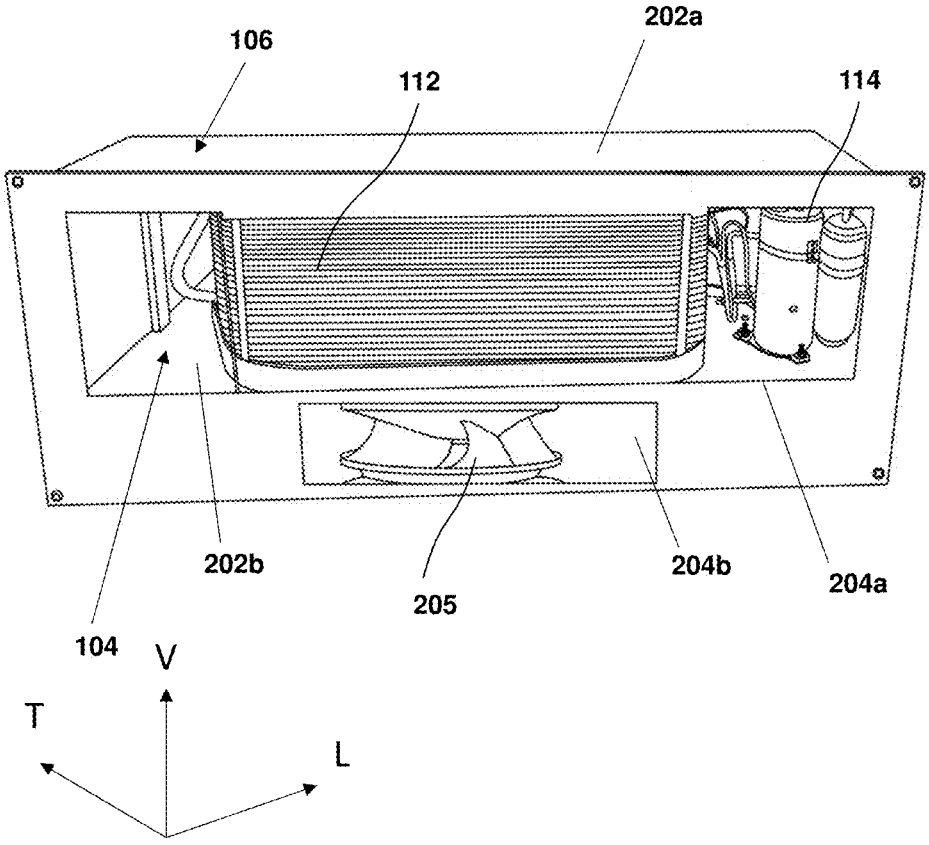
Figure 11:
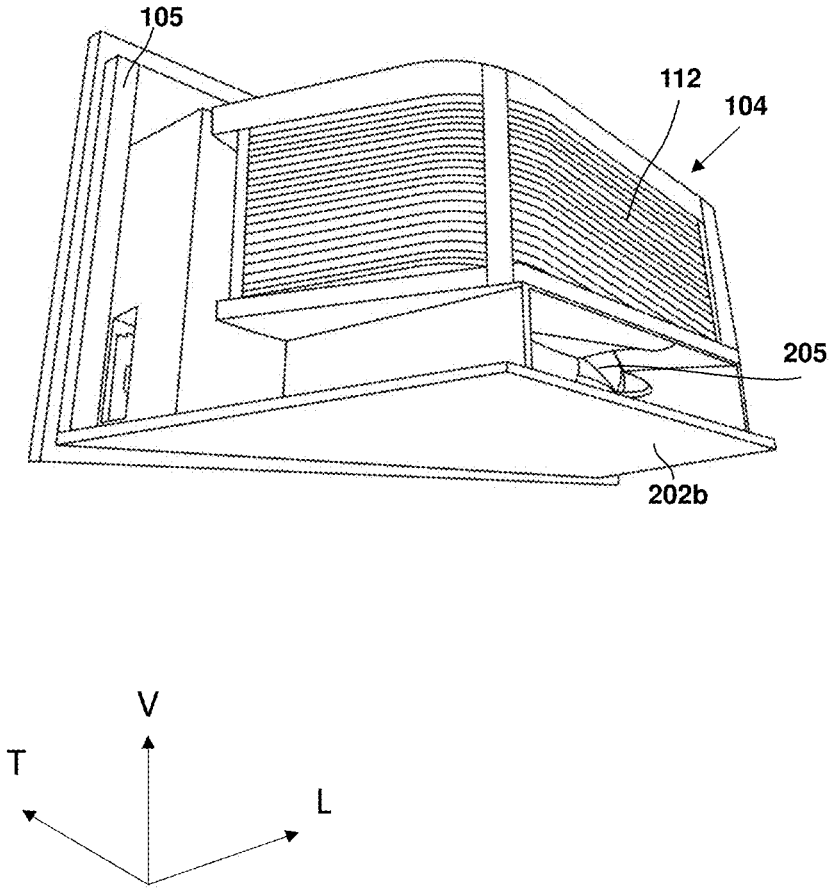

According to another embodiment of the present invention, the outdoor coil 112 is strategically shaped in a C shape or L shape, and the outdoor fan 205 is horizontally positioned at the bottom of the outdoor coil 112 as seen in FIGS. 9-11. In operation, the air is pulled from the inside of the outdoor unit 104 (and passed through the coil) and downward and is discharged out from the bottom by the outdoor fan 205 as indicated by the arrows in FIGS. 9-11.

Hereinafter the improved PTAC unit or PTAC system is referred to as 100, the inventor herein proposes a new and improved configuration or placement for the outdoor heat exchanger/outdoor coil 112, the outdoor fan 205, and the compressor unit 114, and associated flow lines of the outdoor portion 104 within the housing/sleeve 106 preferably mounted on a bottom plate 202*b*. This reconfiguration of the outdoor heat exchanger 112 and the specific C shape or L shape of the outdoor heat exchanger, and reconfiguration of the outdoor fan 205, and the compressor unit 114 create additional space within the sleeve 106 as well. The C-shaped or L-shaped outdoor heat exchanger 112 is placed at the back of separation wall 105 such that the two wings 112*a*, and 112*b* of the C-shaped outdoor heat exchanger 112 faces the separation wall 105 or one wing (not seen) of the L-shaped outdoor heat exchanger 112 faces the separation wall 105.

Figure 3:
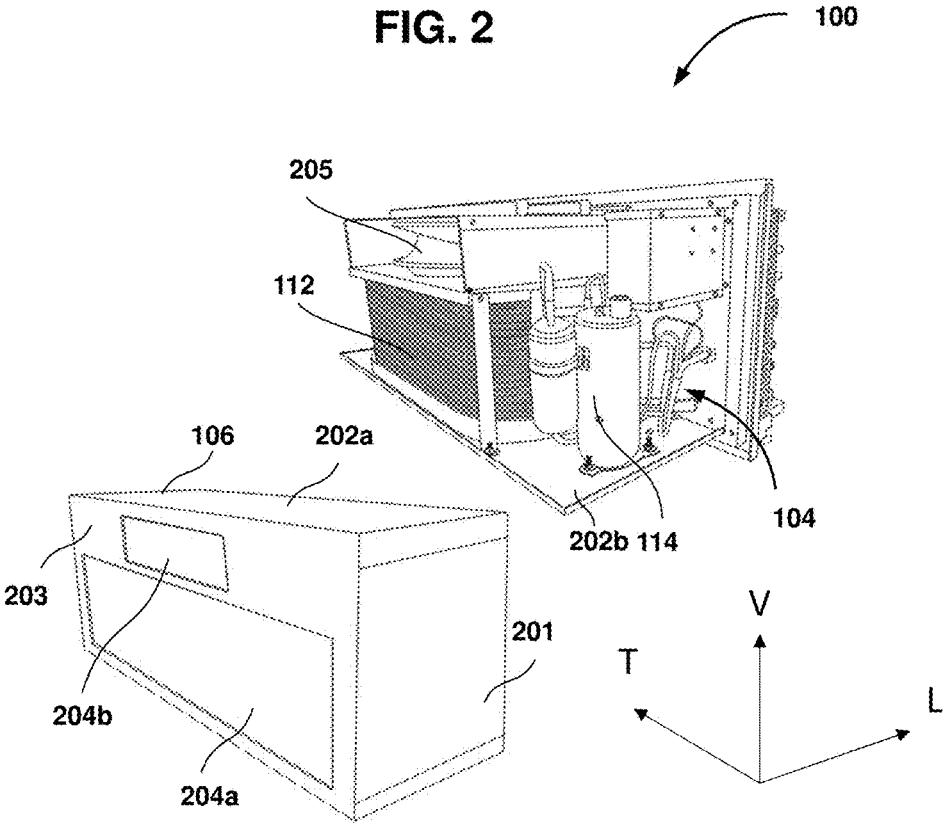
Figure 4:
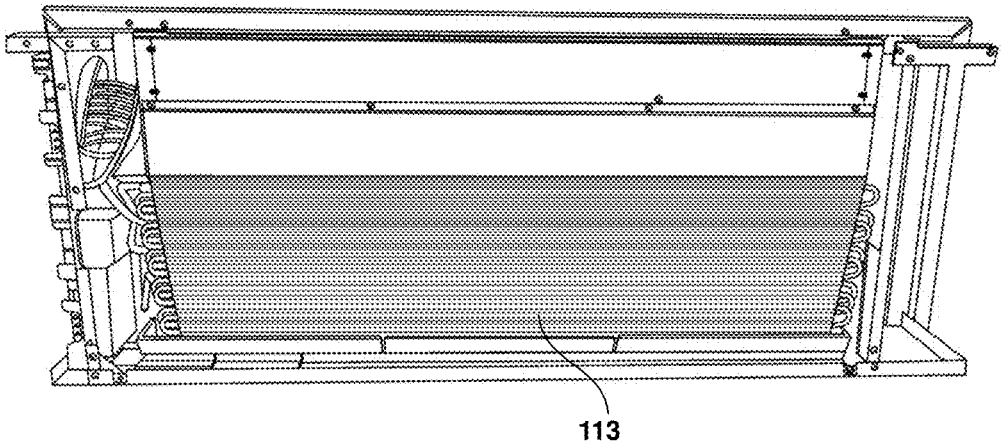
FIG. 4 shows a front view of the PTAC system of FIG. 2 with the front panel and sleeve removed.

The sleeve/housing 106 is further provided with a backplate 203 (FIG. 3) connecting a pair of sidewalls 201 of the sleeve 106. The sleeve 106 also includes a top wall 202*a*. The plate 203 has a cut-out section 204*a* for revealing the C-shaped outdoor coil or curved coil 112. The plate 203 has another cut-out section 204*b* for revealing the outdoor fan 205. The outdoor fan 205 is preferably an exhaust fan able to suck/draw air from the bottom towards upward from the outdoor portion 104 and throw it outside. In contrast to the positioning of the outdoor fan in traditional PTAC unit 100 (FIGS. 1A and 1B), the outdoor fan 205 in the PTAC unit 100 is configured in a horizontal fashion along the vertical direction V facing upward towards the top wall of the sleeve 106.

In another alternative embodiment, with the outdoor fan 205 being configured at the bottom of the outdoor coil 112, the cut-out sections 204*a*, and 204*b* will interchange their locations to reveal the outdoor coil 112 and the outdoor fan 205. The outdoor fan 205 is preferably an exhaust fan able to suck/draw air from the top which will then be directed downward from the outdoor portion 104 and thrown outside from the bottom.

Figure 7:
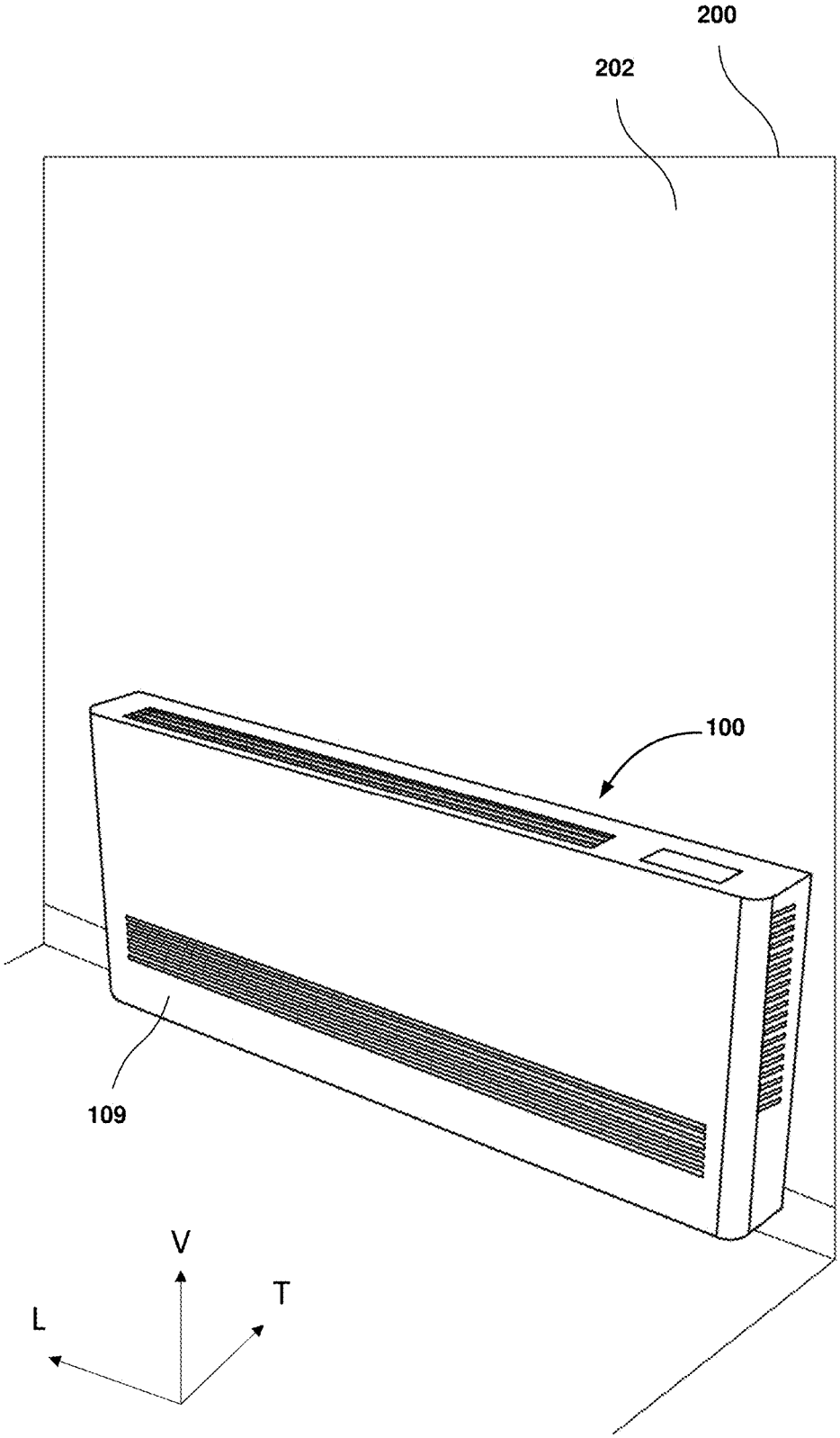
FIG. 7 shows the PTAC system of the present invention mounted on an external wall.
Figure 8:
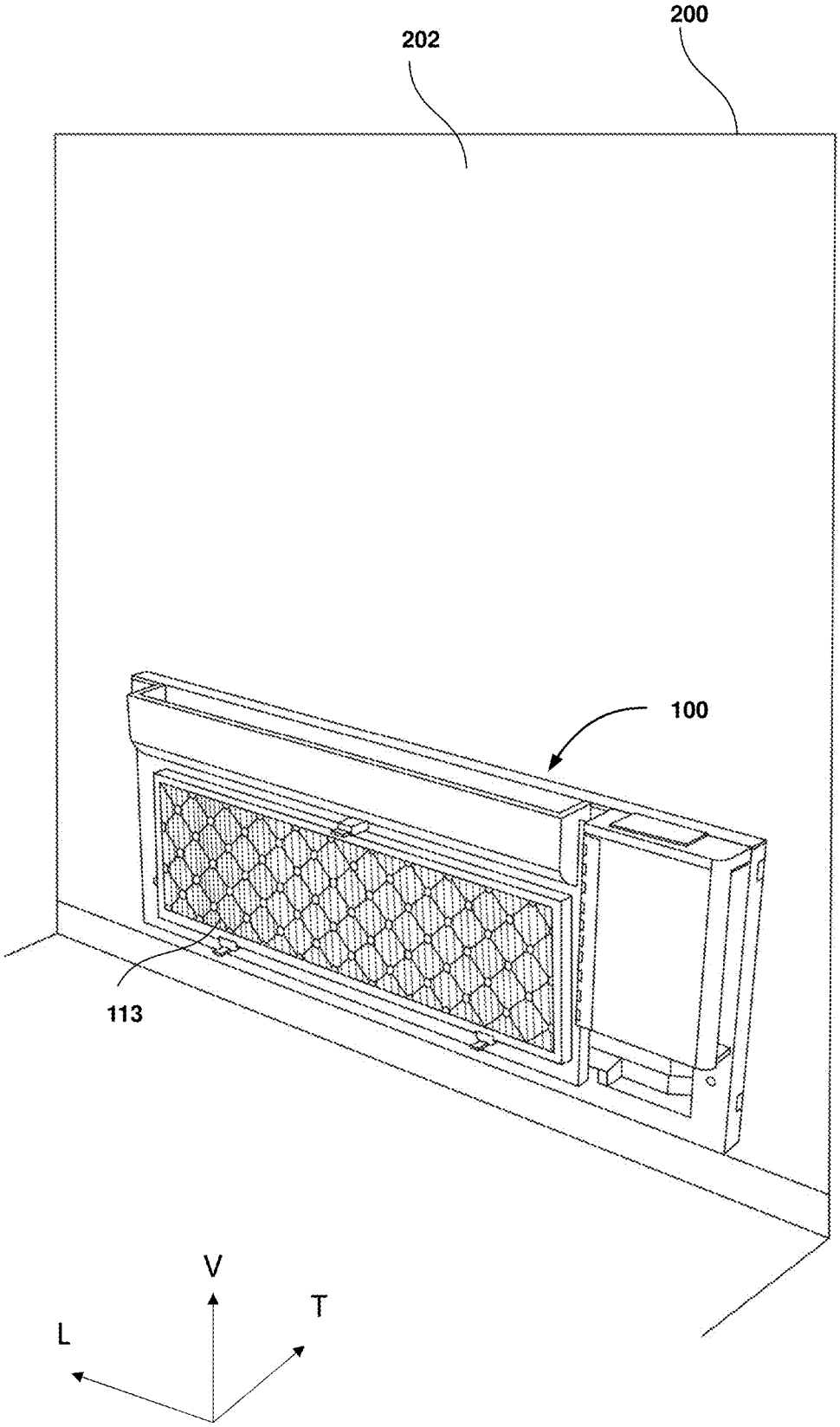
FIG. 8 shows the PTAC system of the present invention mounted on an external wall with the front panel cover.

Referring to FIGS. 7-8, the proposed PTAC system 100 is shown configured on an external wall 200.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the present invention.

What is claimed is:

1. A packaged terminal air conditioner (PTAC) system (100), comprising:

an indoor portion (102), and an outdoor portion (104), wherein the indoor portion (102), and the outdoor portion (104) are separated by an intermediate separation wall (105);

a sleeve (106) comprising at least a pair of side walls (201), a top wall (202*a*), and a back plate (203), wherein the sleeve (106) is configured to enclose the outdoor portion (104) comprising at least an outdoor coil (112), and an outdoor fan (205);

wherein, the outdoor coil (112) comprises at least one wing (112*a*, 112*b*);

wherein, the outdoor fan (205) is configured horizontally along a vertical direction (V) facing at least towards the top wall (202*a*) of the sleeve (106) and located above the outdoor coil (112), or towards a bottom plate (202*b*) located below the outdoor coil (112); and wherein the outdoor fan (205) when configured facing the bottom plate (202*b*) and located below the outdoor coil (112) pulls hot air inside the outdoor portion (104) downward which is then discharged out from bottom through the outdoor fan (205).

2. The PTAC system (100) of claim 1, wherein the outdoor fan (205) when configured facing the top wall (202*a*) of the sleeve (106) and located above the outdoor coil (112) pulls hot air inside the outdoor portion (104) upward which is then discharged out from top through the outdoor fan (205).

3. The PTAC system (100) of claim 1, wherein the outdoor coil (112) comprises a single wing (112*a* or 112*b*) leading to an L-shaped configuration for the outdoor coil (112).

4. The PTAC system (100) of claim 1, wherein the outdoor coil (112) comprises a pair of wings (112*a*, 112*b*) leading to a C-shaped configuration for the outdoor coil (112).

5. The PTAC system (100) of claim 1, wherein the outdoor coil (112) is placed at the back of the intermediate separation wall (105) such that the at least one wing (112*a* or 112*b*) of the outdoor coil (112) remains oriented facing the intermediate separation wall (105).

6. The PTAC system (100) of claim 1, wherein the back plate (203) comprises a first cut-out section (204*a*) for revealing the outdoor coil (112) and a second cut-out section (204*b*) for revealing the outdoor fan (205).

7. A packaged terminal air conditioner (PTAC) system (100), comprising:

an indoor portion (102), and an outdoor portion (104), wherein the indoor portion (102), and the outdoor portion (104) are separated by an intermediate separation wall (105);

a sleeve (106) comprising at least a pair of side walls (201), a top wall (202*a*), and a back plate (203), wherein the sleeve (106) is configured to enclose the outdoor portion (104) comprising at least an outdoor coil (112), and an outdoor fan (205);

wherein, the outdoor coil (112) comprises at least one wing (112*a*, 112*b*) and wherein the back plate (203) comprises a first cut-out section (204*a*) for revealing the outdoor coil (112) and a second cut-out section (204*b*) for revealing the outdoor fan (205); and wherein, the outdoor fan (205) is configured horizontally along a vertical direction (V) facing at least towards the top wall (202*a*) of the sleeve (106) and located above the outdoor coil (112), or towards a bottom plate (202*b*) located below the outdoor coil (112).

8. The PTAC system (100) of claim 7, wherein the outdoor fan (205) when configured facing the top wall (202*a*) of the sleeve (106) and located above the outdoor coil (112) pulls hot air inside the outdoor portion (104) upward which is then discharged out from top through the outdoor fan (205).

9. The PTAC system (100) of claim 7, wherein the outdoor coil (112) comprises a single wing (112*a* or 112*b*) leading to an L-shaped configuration for the outdoor coil (112).

10. The PTAC system (100) of claim 7, wherein the outdoor coil (112) comprises a pair of wings (112*a*, 112*b*) leading to a C-shaped configuration for the outdoor coil (112).

11. The PTAC system (100) of claim 7, wherein the outdoor coil (112) is placed at the back of the intermediate separation wall (105) such that the at least one wing (112*a* or 112*b*) of the outdoor coil (112) remains oriented facing the intermediate separation wall (105).

12. The PTAC system (100) of claim 7, wherein the outdoor fan (205) when configured facing the bottom plate (202*b*) and located below the outdoor coil (112) pulls hot air inside the outdoor portion (104) downward which is then discharged out from bottom through the outdoor fan (205).

* * * * *